US010512308B2

(12) United States Patent
Paik et al.

(10) Patent No.: US 10,512,308 B2
(45) Date of Patent: Dec. 24, 2019

(54) BUCKLE ASSEMBLED WITH WHISTLE

(71) Applicant: WOOJIN PLASTIC CO., LTD., Gyeonggi-do (KR)

(72) Inventors: Jisook Paik, Seoul (KR); Nan Hee Paik, Seoul (KR); Ji Hye Paik, Seoul (KR); Ji Won Son, Seoul (KR)

(73) Assignee: Woojin Plastic Co., LTD, Guri si (KR)

( * ) Notice: Subject to any disclaimer, the term of this patent is extended or adjusted under 35 U.S.C. 154(b) by 0 days.

(21) Appl. No.: 15/942,508

(22) Filed: Mar. 31, 2018

(65) Prior Publication Data

US 2019/0200709 A1 Jul. 4, 2019

(30) Foreign Application Priority Data

Jan. 4, 2018 (KR) ..... 10-2018-0001290

(51) Int. Cl.

| | |
|---|---|
| ***A44B 11/25*** | (2006.01) |
| ***A44B 11/00*** | (2006.01) |
| ***G10K 5/00*** | (2006.01) |
| ***A44B 11/26*** | (2006.01) |

(52) U.S. Cl.

CPC ..... *A44B 11/005* (2013.01); *A44B 11/266* (2013.01); *G10K 5/00* (2013.01)

(58) Field of Classification Search

CPC ..... A44B 11/005; A44B 11/266; G10K 5/00

See application file for complete search history.

(56) References Cited

U.S. PATENT DOCUMENTS

| | | | | |
|---|---|---|---|---|
| 4,121,375 | A * | 10/1978 | Erickson | A63H 5/00 446/204 |
| 5,794,316 | A * | 8/1998 | Anscher | A44B 11/266 24/615 |
| 10,219,587 | B1 * | 3/2019 | Chan | A44B 11/005 |
| 2014/0109615 | A1 * | 4/2014 | Millan | B26B 9/00 63/1.12 |

FOREIGN PATENT DOCUMENTS

| | | |
|---|---|---|
| KR | 10-0995471 | 11/2010 |

* cited by examiner

*Primary Examiner* — Abigail E Troy

(57) ABSTRACT

The present disclosure relates to a buckle assembled with a whistle, the buckle including: a plug member having locking arms that are formed at both ends at a front side of a base, and a guide rod that protrudes from the base at an intermediate side between the locking arms; and a socket member having a guide groove which is formed at a center of the socket member so as to be opened at an upper side thereof to accommodate the guide rod at the center, and chambers which are formed at both sides of the guide groove so that the locking arms at the both ends are inserted into the chambers, in which the guide rod is configured as the whistle.

4 Claims, 15 Drawing Sheets

BUCKLE ASSEMBLED WITH WHISTLE

CROSS-REFERENCE TO RELATED APPLICATIONS

This application is based on and claims priority from Korean Patent Application No. 10-2018-0001290, filed on Jan. 4, 2018, with the Korean Intellectual Property Office, the disclosure of which is incorporated herein in its entirety by reference.

TECHNICAL FIELD

The present disclosure relates to a buckle assembled with a whistle, and more particularly, to a buckle assembled with a whistle mounted in the buckle which is connected to a belt or a strap to connect or fix the belt or the strap, thereby enabling a user to quickly and conveniently use the whistle at the time of an emergency.

BACKGROUND

In general, a buckle is widely used to fasten a belt or a strap for a climbing knapsack, a student bag, or the like, and particularly, articles, for which the buckle is used, are mainly used when users enjoy outdoor activities.

That is, the articles, for which the buckle is used, may be found around several living spaces, and particularly, the users, who enjoy outdoor activities such as hiking, boating, camping, and mount climbing, use the articles having multiple buckles to fasten the articles for various purposes.

Meanwhile, during the outdoor activities, there may be various emergency situations such as a situation in which an emergency rescue needs to be requested, a situation in which voice cannot be sufficiently heard from far away, and a situation in which voice cannot be clearly heard due to peripheral noise. Therefore, the persons, who conduct the activities that may cause an emergency situation, are recommended to bring a safety whistle.

The whistle refers to a device that produces sound while vibrating as a user blows air and the air flows through a flue, and the whistle is mainly used to produce a signal for notifying other people of an emergency situation that may occur during an outdoor activity.

However, even though anybody may experience the emergency situations, it is difficult for users to always bring the whistle when the users are involved in the outdoor activities because the most of the users expect that the emergency situations do not happen to them. Therefore, since the users do not have the whistles even though an emergency situation actually occurs, the users cannot notify other people of the emergency situation, which causes an accident.

Patent Document 1 discloses a buckle which is equipped with a whistle to allow a user to carry the whistle and conveniently use the whistle at the time of an emergency, and the buckle includes a buckle main body which is fastened to an end portion of a belt, and a whistle which is detachably mounted on a sliding part formed at one side of the buckle main body.

However, according to Patent Document 1, the whistle is assembled and fixed to one end outside the buckle, such that the whistle protrudes outward from the buckle, and as a result, an overall volume of the buckle is increased, and the protruding part interferes with a peripheral object or may be damaged while coming into contact with the peripheral object, thereby demanding attention.

In addition, when the user mounts the whistle on the buckle and carries the whistle as described in Patent Document 1, there is also a hygienic problem caused by various types of dust, foreign substances, or the like because main parts of the whistle protrude and thus easily come into contact with external objects.

Therefore, there is a need for a technology capable of enabling a user to conveniently carry a whistle and solving heterogeneity caused by the protruding parts of the whistle described in Patent Document 1 and inconvenience caused by the heterogeneity.

DOCUMENT OF RELATED ART

Patent Document 1.1. Korean Patent No. 10-0995471 (Nov. 12, 2010)

SUMMARY

The present disclosure has been made in an effort to provide a buckle assembled with a whistle which is provided to be detachable from the buckle, thereby forming integrity with the buckle to minimize outwardly protruding portions and reduce heterogeneity, and solving inconvenience caused by interference with external objects.

The present disclosure has also been made in an effort to provide a buckle assembled with a whistle, which enables hygienic use by minimizing exposure of main parts of a whistle to the outside.

An exemplary embodiment of the present disclosure provides a buckle assembled with a whistle, the buckle including: a plug member having locking arms that are formed at both ends at a front side of a base, and a guide rod that protrudes from the base at an intermediate side between the locking arms; and a socket member having a guide groove which is formed at a center of the socket member so as to be opened at an upper side thereof to accommodate the guide rod at the center, and chambers which are formed at both sides of the guide groove so that the locking arms at the both ends are inserted into the chambers, in which the guide rod is configured as the whistle.

The whistle may include: a whistle which is configured to produce sound; and a whistle cap which is formed integrally with the base of the plug member and inserted into a rear end portion of the whistle.

The whistle may include: a whistle which is configured to produce sound; and a whistle cap which is inserted into a rear end portion of the whistle and detachably assembled to the base of the plug member.

A catching protrusion, which protrudes outward, may be formed at a tip portion of the whistle cap, and a catching groove to which the catching protrusion is coupled may be formed in an inner surface at the rear end portion of the whistle.

The whistle cap may have an inclined outer surface which is narrowed outward from the base, and an inner surface at the rear end portion of the whistle may have a shape corresponding to the outer surface of the whistle cap, such that the inner surface of the whistle and the outer surface of the whistle cap are tightly coupled to each other.

A loop hole into which a portable strap may be fitted may be formed at one end of the whistle or the whistle cap, thereby allowing a user to carry the whistle separately.

A coupling groove into which the whistle cap is fitted may be formed in the base, and a coupling portion which is fitted into the coupling groove may be formed at a rear end portion of the whistle cap, such that the whistle cap is attached to or detached from the base.

The coupling groove may be partially opened at a front side thereof inside the plug member so as to have a T-shaped cross section, and the coupling portion of the whistle cap may have a T-shaped cross section coincident with the coupling groove, such that the whistle cap is fitted by sliding from the inside of the plug member.

A fixing groove may be formed at one end of the coupling groove, and a fixing protrusion, which corresponds to the fixing groove when the whistle cap is coupled, may be formed at one end of the whistle cap, such that a state in which the whistle cap is coupled to the coupling groove is maintained.

A cover, which protects the whistle and the whistle cap coupled to the coupling groove, may be formed to extend outside the coupling groove.

According to the present disclosure, the whistle is configured to be detachable from the buckle to form integrity with the buckle and minimize outwardly protruding portions, thereby reducing an overall volume, and providing an aesthetically attractive external appearance without heterogeneity.

According to the present disclosure, outwardly protruding portions are minimized in a state in which the whistle is mounted in the buckle, such that inconvenience caused by interference with external objects while in use may be prevented, thereby enabling convenient use.

According to the present disclosure, exposure of main parts of the whistle is minimized when the whistle is mounted in the buckle, such that contact between the whistle and dust or foreign substances flowing from the outside is prevented, thereby enabling hygienic use.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIGS. 1 to 6 illustrate a first exemplary embodiment of the present disclosure, in which FIG. 1 is a perspective view of a buckle according to the present disclosure, FIG. 2 is an exploded perspective view of the buckle according to the present disclosure, FIG. 3 is an exploded perspective view when viewed in another direction, FIG. 4 is a front view of a plug member according to the present disclosure, FIG. 5 is an exploded cross-sectional view of a whistle and the plug member according to the present disclosure, and FIG. 6 is a coupled cross-sectional view of the whistle and the plug member according to the present disclosure.

FIGS. 7 to 15 illustrate a second exemplary embodiment of the present disclosure, in which FIG. 7 is a perspective view of a buckle according to the present disclosure, FIG. 8 is a front view of FIG. 7, FIG. 9 is a front view illustrating a state in which a buckle according to the present disclosure is disassembled, FIG. 10 is an exploded perspective view of the buckle according to the present disclosure, FIG. 11 is a rear exploded perspective view of the buckle according to the present disclosure, FIG. 12 is an exploded perspective view of a whistle and a plug member, FIG. 13 is a rear perspective view illustrating a state in which the whistle and the plug member are coupled, FIG. 14 is a cross-sectional view illustrating a state in which the whistle and a whistle cap are separated, and FIG. 15 is a cross-sectional view illustrating a state in which the whistle and the whistle cap are coupled.

DETAILED DESCRIPTION

Figure 1:
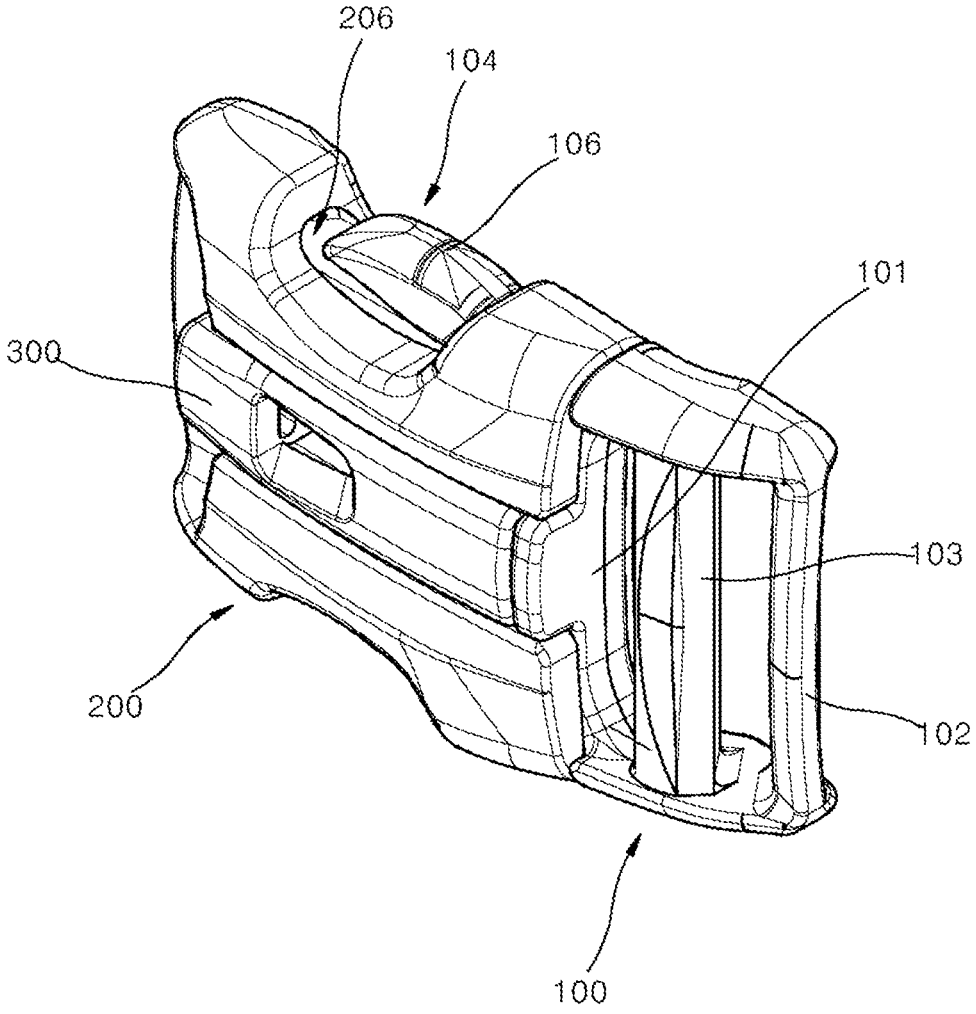

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, specific contents of the present disclosure will be described in detail with reference to the accompanying drawings. Here, thicknesses of lines illustrated in the drawings, sizes of constituent elements, or the like may be exaggerated for clarity and convenience of description.

In addition, the terms used in the following description are defined considering the functions in the present disclosure and may vary depending on the intention or usual practice of a user or an operator. Therefore, the definition of the terms should be made based on the entire contents of the present specification.

In the drawings, like reference numerals designate like elements.

A buckle to which the present disclosure is applied is mounted on a belt, a strap, or the like attached to an article such as a climbing knapsack, a student bag, or a helmet and serves to connect or separate two straps. To this end, the buckle includes a plug member and a socket member that may be attached to and detached from each other.

The belt or the strap is attached to a climbing knapsack, a bag, or the like as described above. In the case of the climbing knapsack, the belt or the strap may be applied as various straps including a shoulder strap, a chest strap, and a waist strap. The belt or the strap may be applied as a concept including straps or belts for all purposes for connection and separation.

Figure 2:
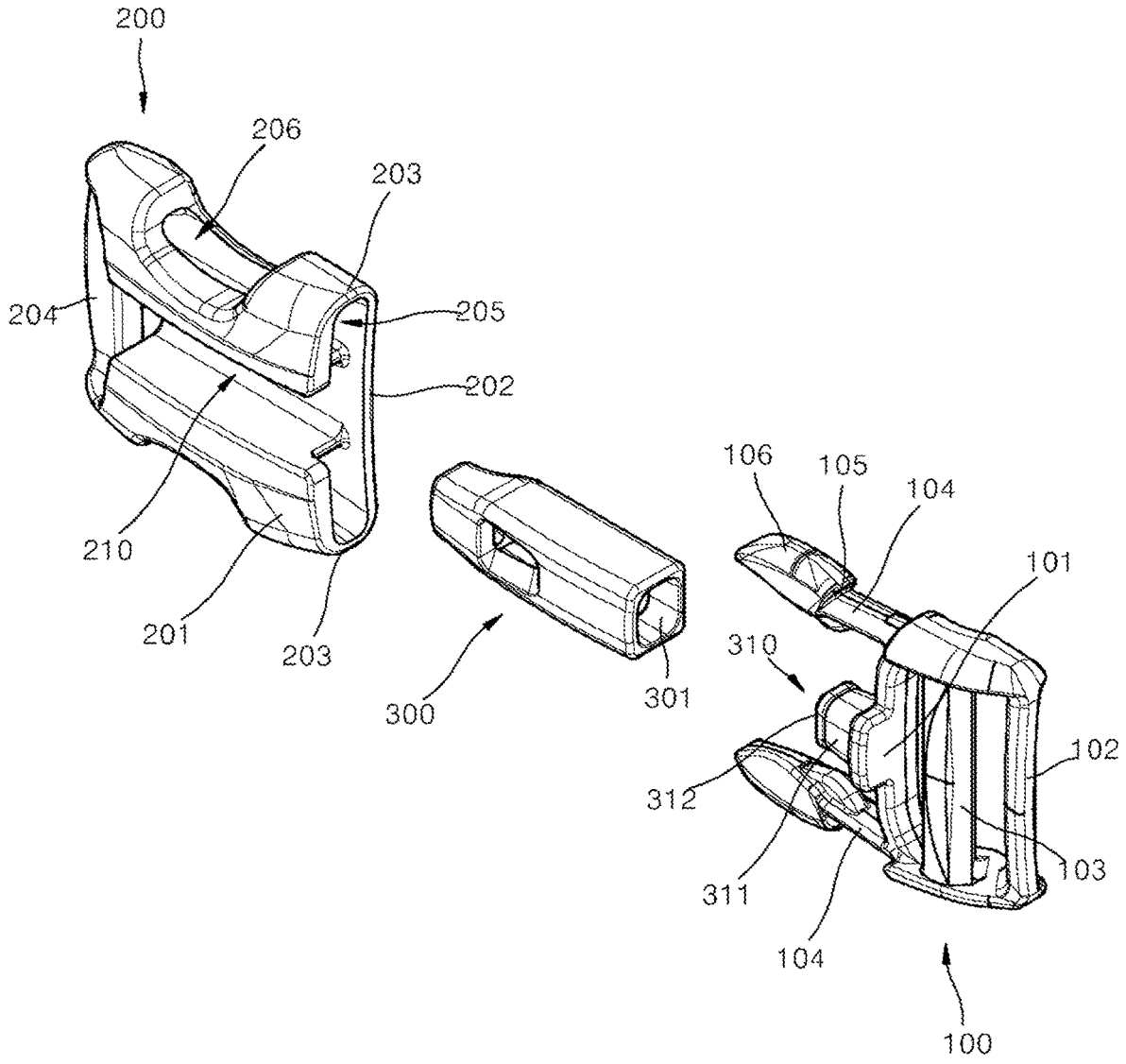
Figure 3:
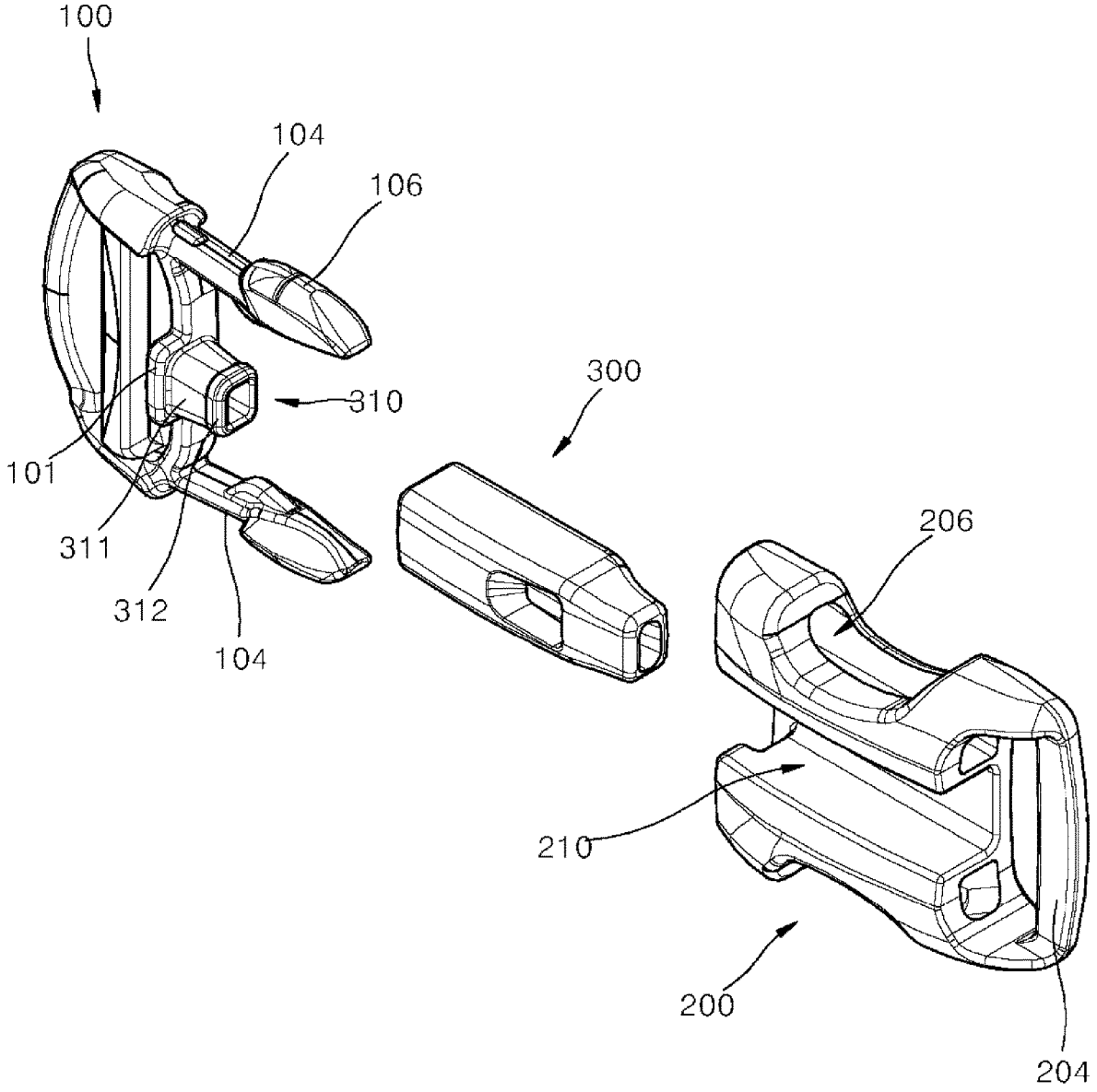
Figure 4:
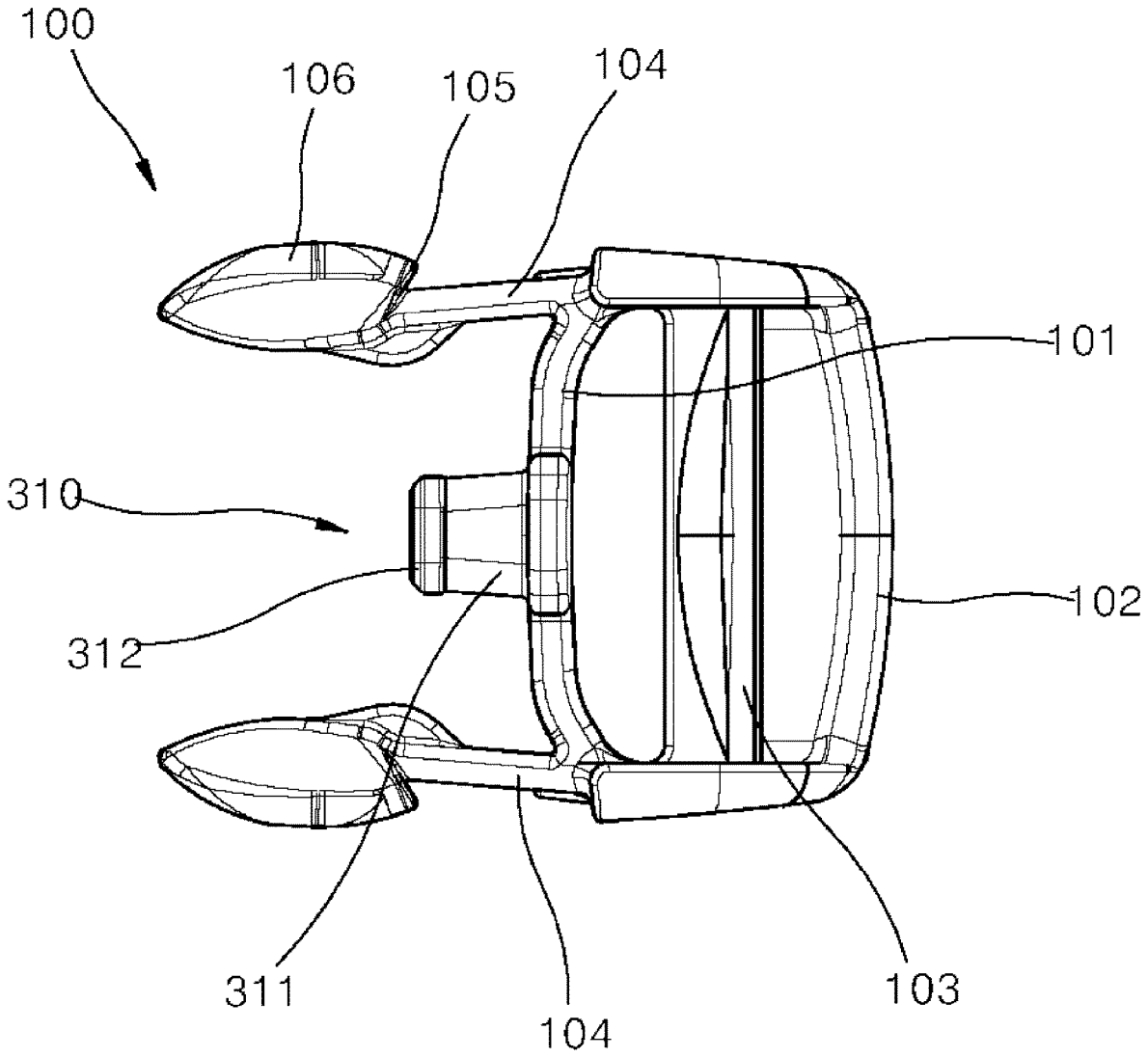
Figure 5:
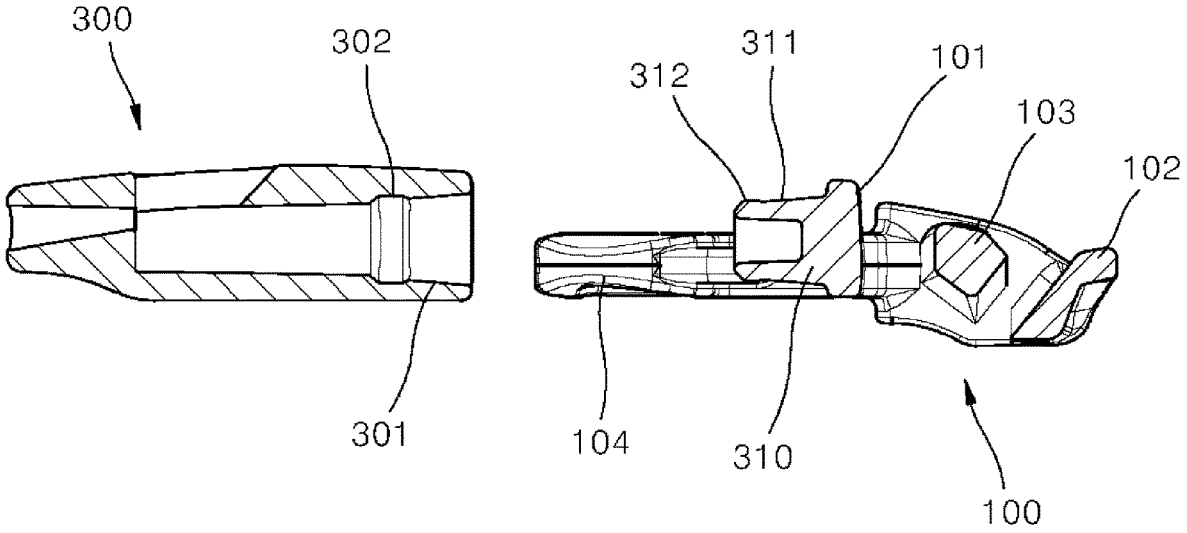
Figure 6:
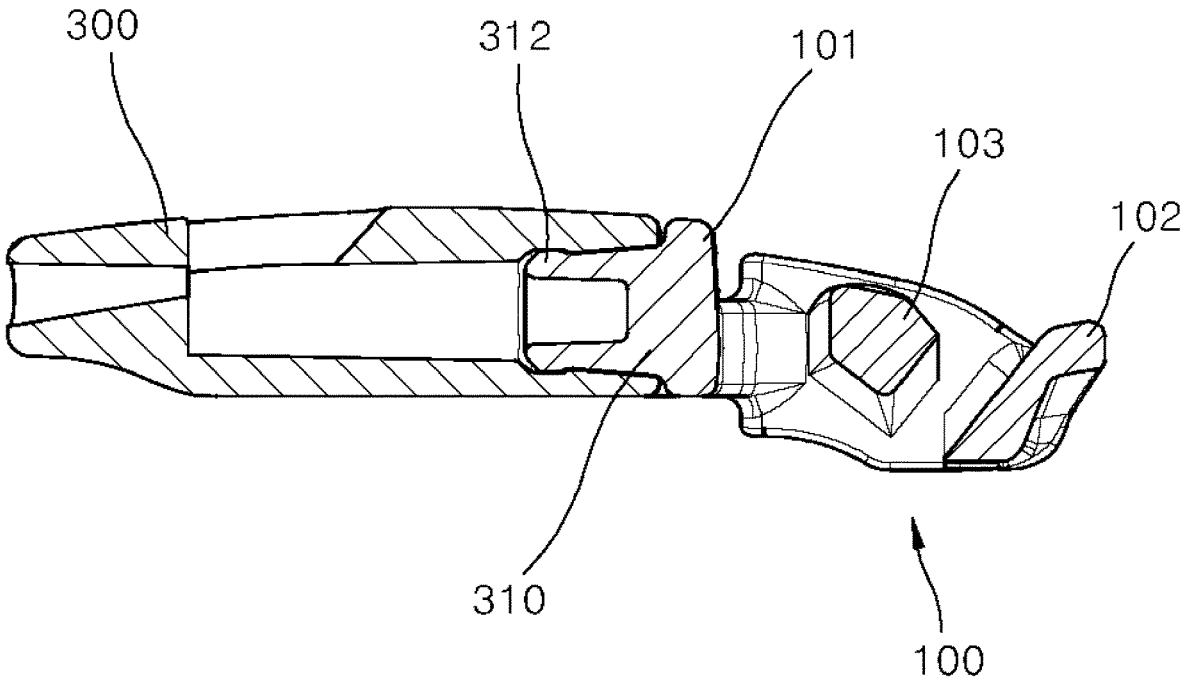
Figure 7:
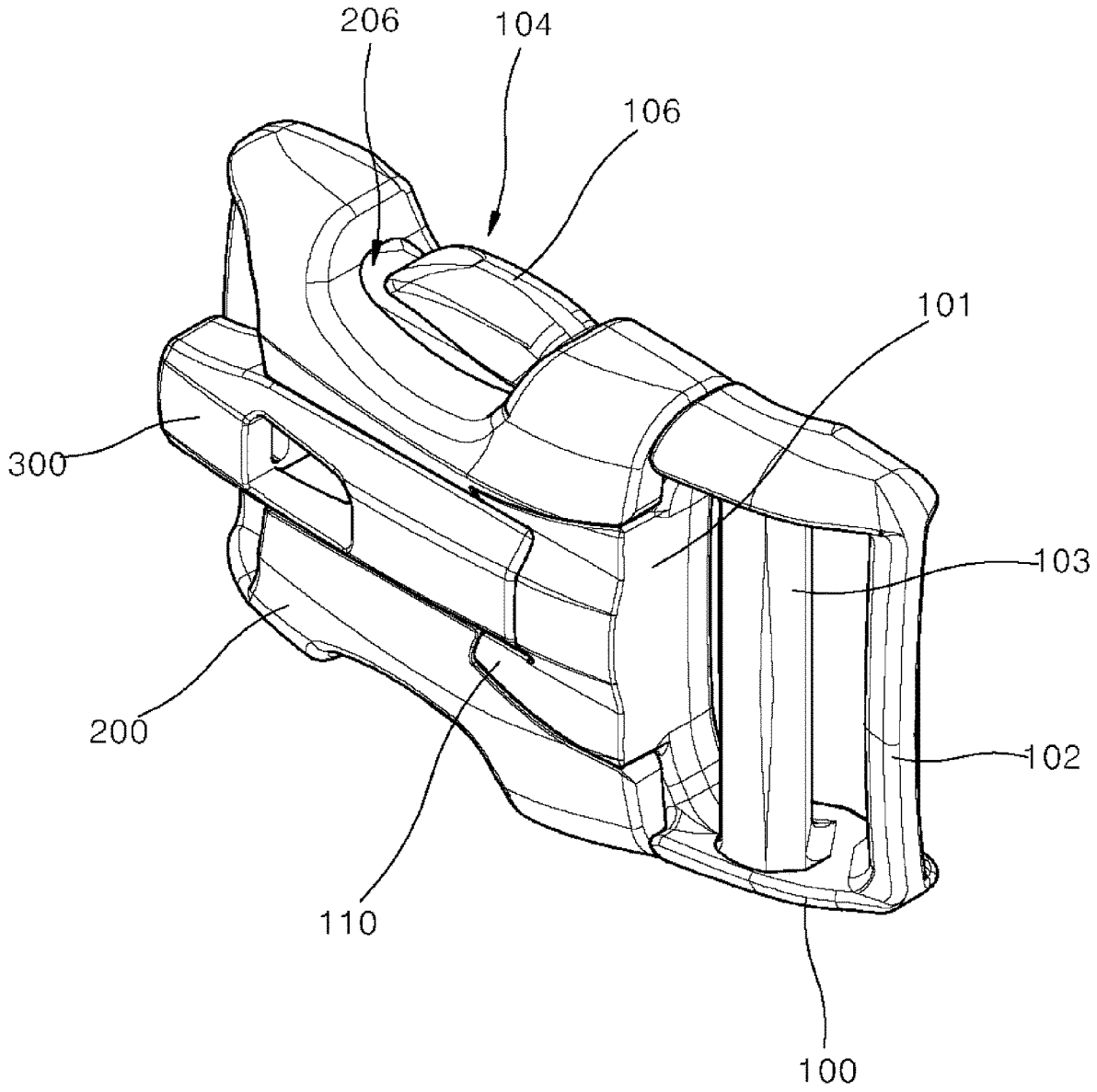
Figure 8:
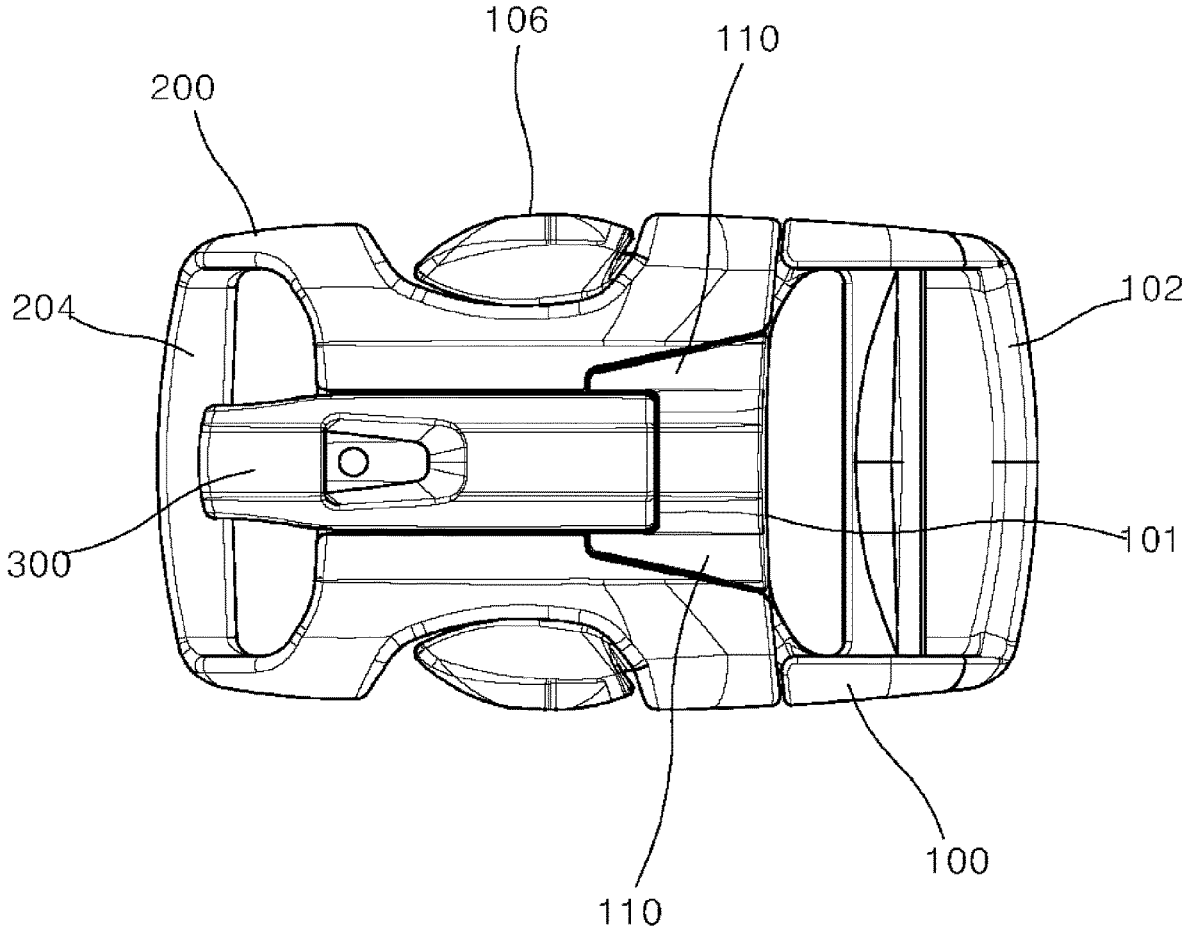
Figure 9:
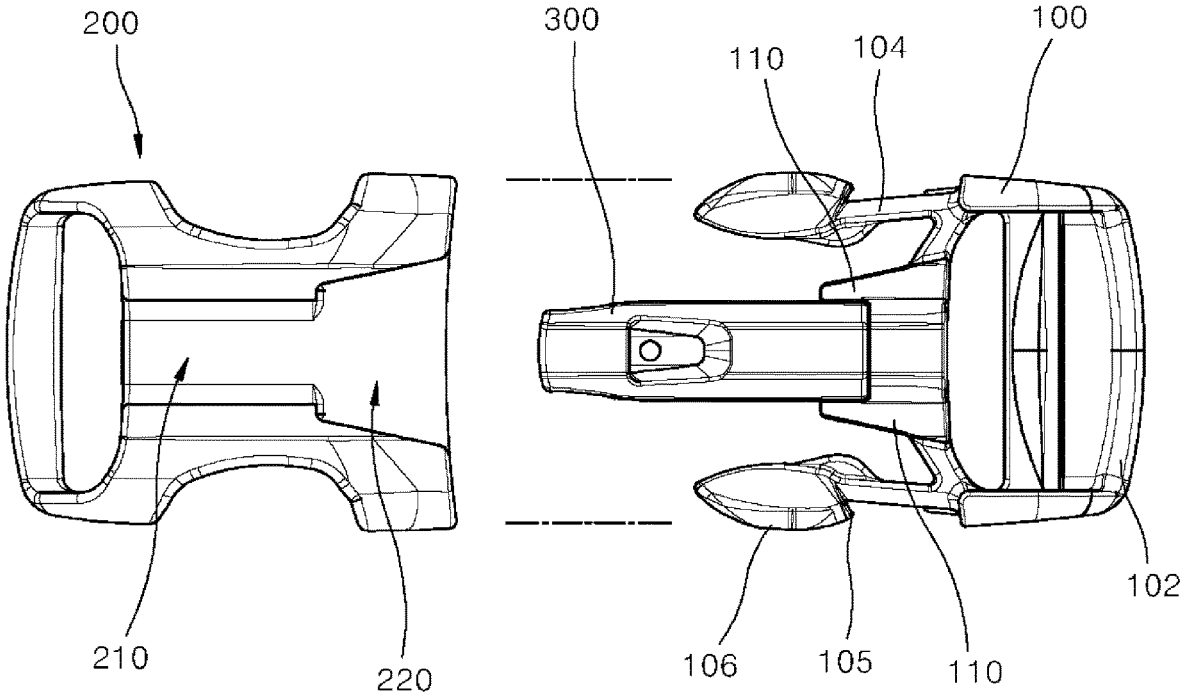
Figure 10:
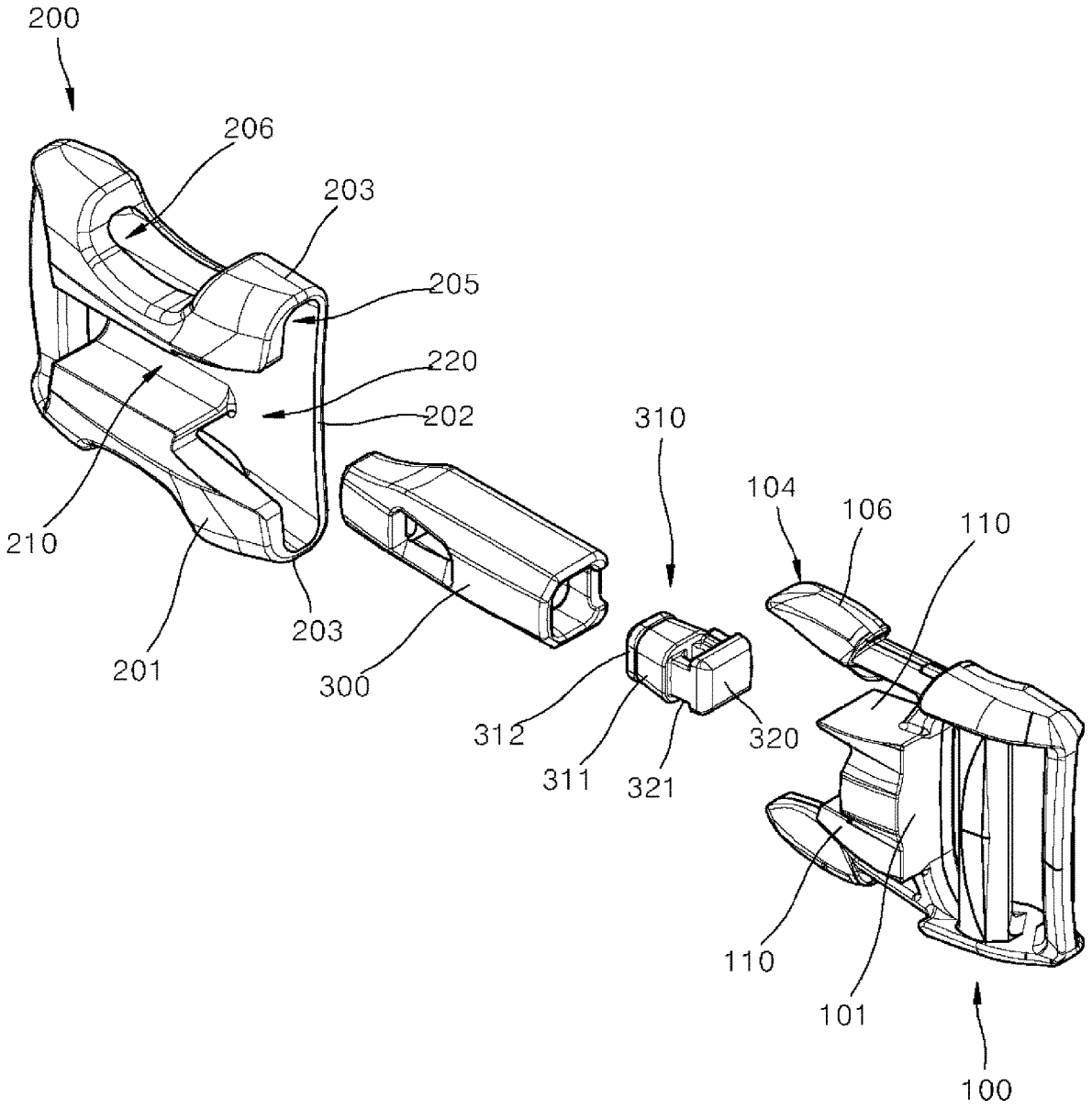
Figure 11:
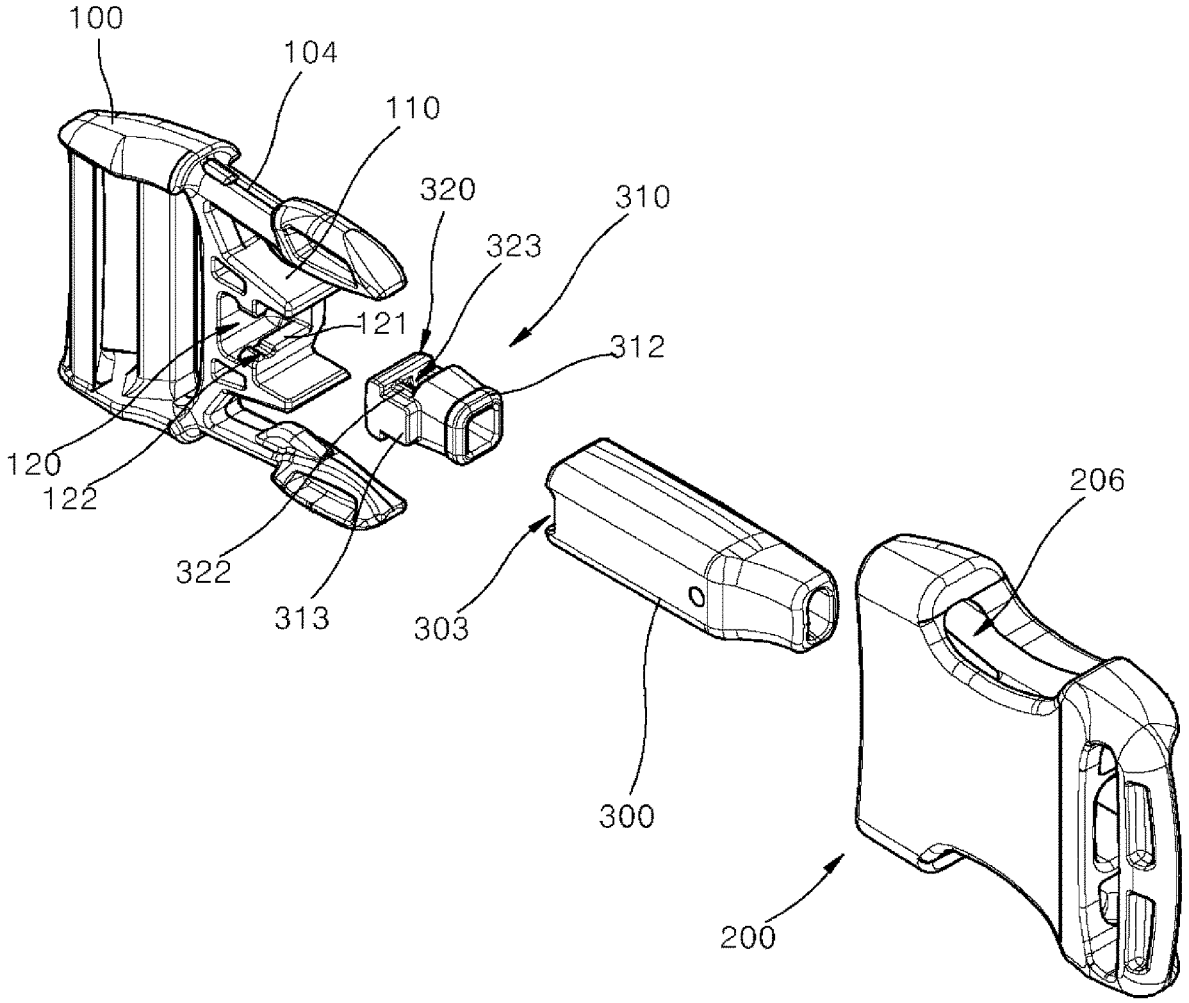
Figure 12:
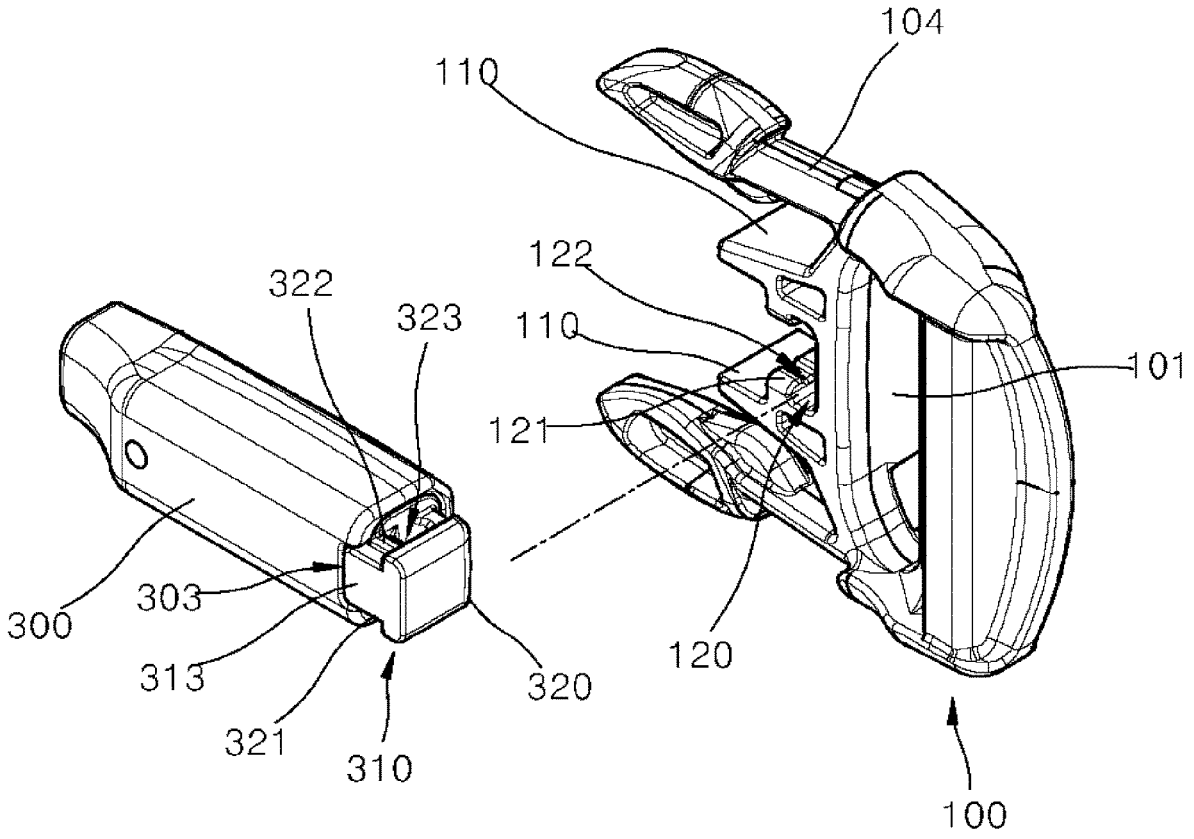
Figure 13:
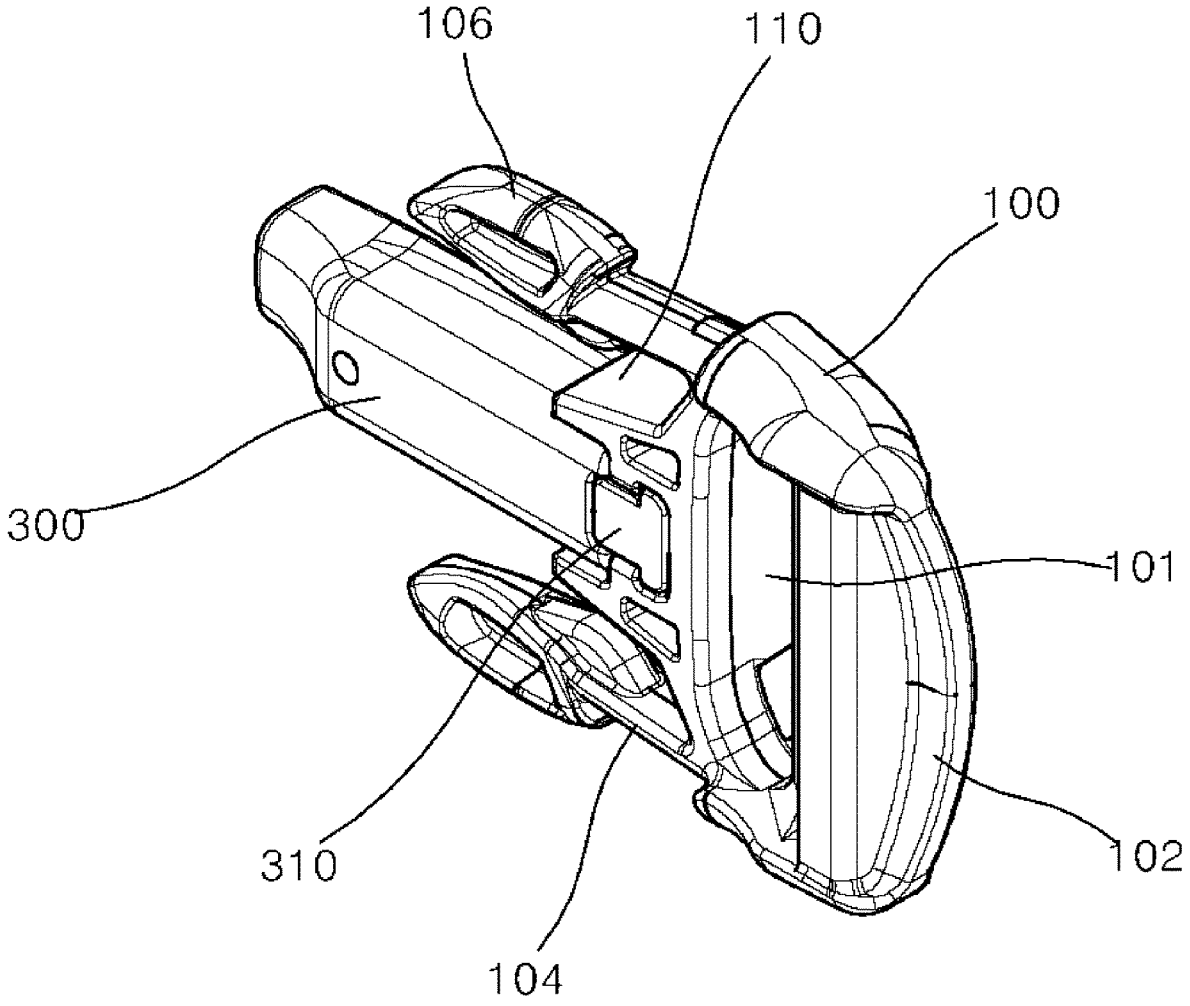
Figure 14:
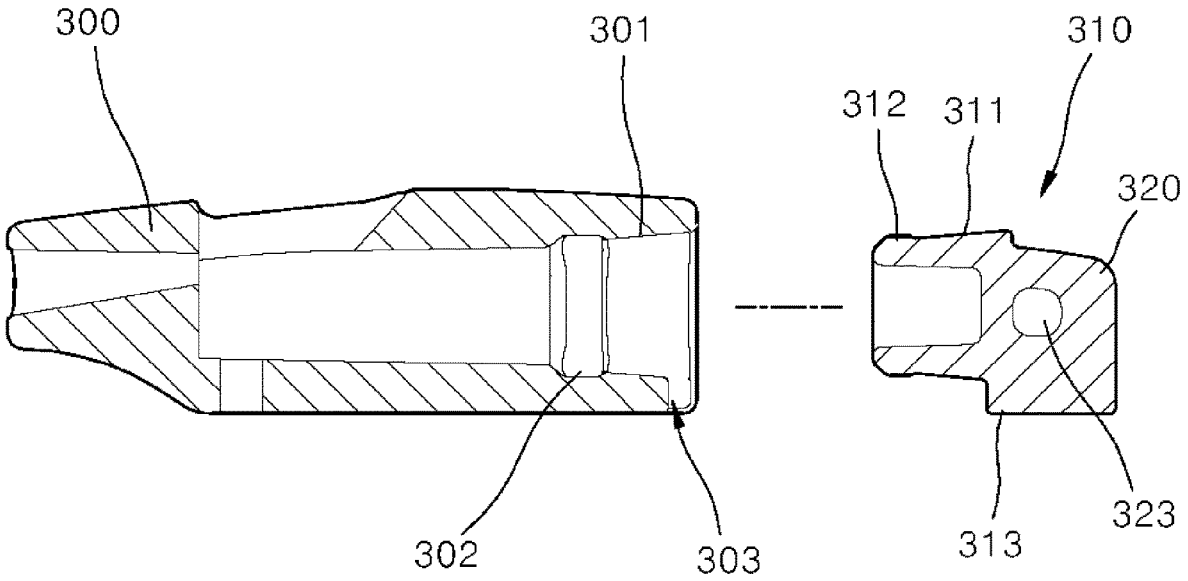
Figure 15:
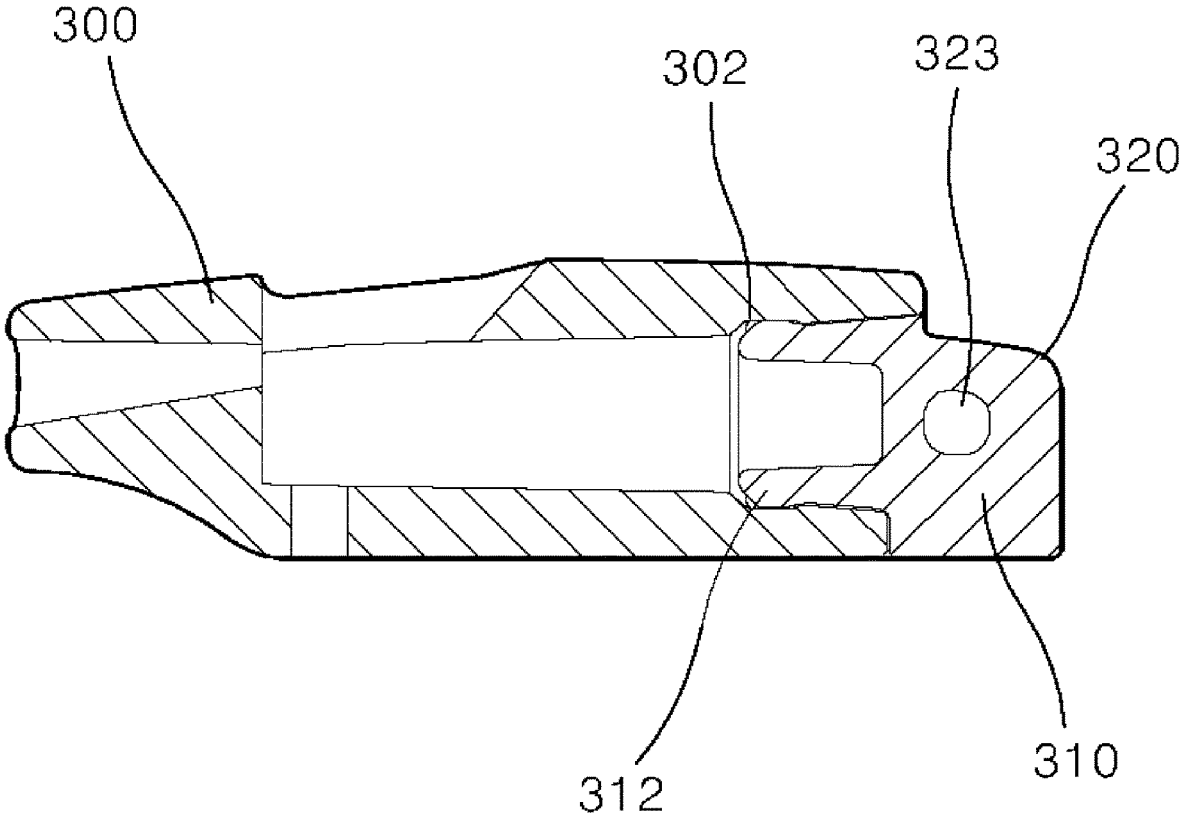

FIGS. 1 to 6 illustrate a first exemplary embodiment of the present disclosure, FIG. 1 is a perspective view of a buckle according to the present disclosure, FIG. 2 is an exploded perspective view of the buckle according to the present disclosure, FIG. 3 is an exploded perspective view when viewed in a direction different from a direction in FIG. 1, FIG. 4 is a front view of a plug member according to the present disclosure, FIG. 5 is a cross-sectional view of the plug member according to the present disclosure, and FIG. 6 is a cross-sectional view illustrating a state in which a whistle is coupled to the plug member.

Referring to FIGS. 1 to 6, the buckle according to the present disclosure includes a plug member 100, a socket member 200, and a whistle 300.

The plug member 100 has a cross bar 102 and a strap hooking bar 103 which are formed at a rear side of a base 101 so as to traverse laterally so that a free end portion of a strap is wound around the cross bar 102 and the strap hooking bar 103, and the strap is wound around the cross bar 102 and the strap hooking bar 103 in a staggered arrangement so that a length of the strap is adjusted. Otherwise, only the cross bar 102 is provided, and the free end portion of the strap is wound around the cross bar 102 and fixed by sewing.

Locking arms 104 extend forward from both sides of the base 101 in the same direction, and the locking arms 104 are symmetrical to each other with respect to a center of the plug member 100. The locking arm 104 extends from the base 101 while having a small thickness so as to be elastically bent with respect to the base 101. The locking arm 104 has an expanded end portion and has a catching projection 105 at an intermediate portion outside the end portion, such that the locking arm 104 is coupled to the socket member. Outer surfaces of the two locking arms 104, which extend from the catching projections 105 to the tip portions, are defined as pushing portions 106 for separating the buckle.

A whistle cap 310 protrudes forward at a center of the base 101, the whistle cap 310 has an inclined outer surface 311 which is gradually narrowed forward, and a catching protrusion 312 protrudes at an end portion of the whistle cap 310.

The whistle 300, which is opened at a rear side thereof, is fitted with the whistle cap 310, and an inclined inner surface 301, which corresponds to the inclined outer surface 311 of the whistle cap 310, is formed at the opened rear side of the whistle 300, such that the inclined inner surface 301 and the inclined outer surface 311 are in close contact with each other. A catching groove 302 to which the catching protrusion 312 of the whistle cap 310 may be coupled is formed in the whistle 300, such that a state in which the whistle 300 and the whistle cap 310 are fitted with each other in a press-fit manner is maintained.

Here, the whistle 300 may be configured to protrude to be elongated further forward than the locking arms 104 provided at both outer sides in a state in which the whistle 300 is coupled to the whistle cap 310.

When the whistle 300 is coupled as described above, a guide rod, which is defined, by the whistle 300, at the center of the base of the plug member 100, guides the socket member 200 so that the socket member 200 is naturally coupled, such that the coupled state may be stably maintained.

The socket member 200 has an upper plate 201 and a lower plate 202 which face each other, and outer sides of the upper plate 201 and the lower plate 202 are connected through sidewalls 203, such that a chamber 205, which guides and accommodates the plug member 100, is formed inside the upper plate 201 and the lower plate 202. A cross bar 204 for the socket member, which is configured to fix a free end portion of another strap, is formed to traverse laterally at a rear side of the socket member.

Similar to the plug member 100, a strap hooking bar may also be further provided on the socket member 200 so that the strap may be adjusted.

A guide groove 210, which is elongated in a direction in which the plug member 100 is moved, is formed at an intermediate portion of the socket member 200, and the guide groove 210 is formed to divide the chamber 205 into two chambers, such that the guide groove 210 is opened at front, rear, and upper sides thereof. The guide groove 210 has a width to a degree to which the whistle 300, that is, the guide rod may be closely guided without resistance.

When the plug member 100 is fitted with the chamber 205 of the socket member 200, the locking arms 104 of the plug member 100 enter the chamber 205 divided at both sides by the guide groove 210, and the whistle 300 at the center, that is, the guide rod is guided by and enters the guide groove 210. When the plug member 100 and the socket member 200 are completely coupled, the base 101 of the plug member 100 is positioned in an inlet of the chamber 205, and in this case, the whistle 300 is coupled to the guide groove 210 so as to cover the entire guide groove 210.

Therefore, when the plug member 100 and the socket member 200 are coupled to each other, the guide groove 210 is completely covered by the whistle 300, and an upper surface of the whistle 300 is flush with an upper surface of the socket member 200, thereby entirely forming integrity.

Holes 206 are formed in both sidewalls of the socket member 200 and communicate with the chamber 205, and the tip portions of the locking arms 104, that is, the pushing portions 106 are exposed through the holes 206 when the socket member 200 is coupled to the plug member 100. The locking arms 104 are pushed inward while the locking arms 104 pass through the chamber 205, and the locking arms 104 resiliently protrude outward at the positions coincident with the holes 206 and then are seated into the holes 206.

The buckle of the present disclosure, which is configured as described above, may be used by being applied to, for example, a knapsack, and at the time of an emergency during an outdoor activity, the user may immediately use the whistle 300 after separating the plug member 100 of the buckle from the socket member 200.

In particular, when the user carries the whistle 300, the whistle 300 is embedded into the guide groove 210 of the socket member 200 to form integrity without protruding parts, and as a result, the user may conveniently use the whistle 300 and protect the whistle 300 from external foreign substances, which enables hygienic use.

In addition, when the interior of the whistle 300 is contaminated by foreign substances or the like while in use, the user may separate the whistle 300 and the whistle cap 310 and then clean the interior of the whistle 300.

FIGS. 7 to 15 illustrate a second exemplary embodiment of the present disclosure.

In the present exemplary embodiment, because the basic configuration of the plug member 100, that is, configurations such as the locking arms 104, the cross bar 102, and the strap hooking bar 103 and the majority of the configurations of the socket member 200 are identical to those of the first exemplary embodiment, descriptions of the identical configurations will be omitted.

Referring to FIGS. 7 to 15, the second exemplary embodiment is characterized in that the whistle cap 310 is configured to be detachable from the plug member 100 such that the whistle cap 310 may be used in a separated state.

A coupling groove 120 into which the whistle cap 310 may be fitted and coupled is formed in the base of the plug member 100, and the coupling groove 120 is closed at an outer side thereof directed toward the plug member 100 and opened at a front side thereof while having therein an inlet, such that the coupling groove 120 has a T-shaped cross section.

In addition, a coupling portion 320, which has a cross section coincident with the cross section of the coupling groove 120, is formed at a rear end portion of the whistle cap 310, such that the coupling portion 320 may be fitted into the coupling groove 120 from the inside of the plug member 100.

Guide portions 121, which guide and support neck portions 321 of the sliding coupling portion 320, protrude as the front side of the coupling groove 120 is partially opened, and the guide portions 121 allow the whistle cap 310 to stably slide forward and rearward without being withdrawn forward.

A fixing groove 122 is formed at one end of the guide portion 121, and a fixing protrusion 322, which corresponds to the fixing groove 122, protrudes at one end of the neck portion 321 of the whistle cap 310, such that when the coupling portion 320 of the whistle cap 310 is press-fitted into the coupling groove 120, the fixing protrusion 322 is resiliently coupled to the fixing groove 122, and the fitted state of the whistle cap 310 is securely maintained.

Similar to the first exemplary embodiment, the whistle cap 310 has the inclined outer surface 311 inclined downward and forward, the catching protrusion 312 is formed at the end portion of the whistle cap 310, the inclined inner surface 301, which may be in close contact with the inclined outer surface 311, is formed at the rear side of the whistle 300 which is coupled to the whistle cap 310, and the catching groove 302 is formed to be coupled to the catching protrusion 312.

Further, to more stably maintain the coupled state between the whistle 300 and the whistle cap 310, a recessed portion 303 is formed at a rear side of the whistle 300, and a protruding portion 313, which is tightly coupled to the recessed portion 303, is formed at a rear side of the whistle cap 310.

Therefore, when the whistle 300 and the whistle cap 310 are coupled to each other, a secure coupled state is maintained by controlling fluidity in a forward direction and a lateral direction by the engagement between the catching groove 302 and the catching protrusion 312 and the engagement between the recessed portion 303 and the protruding portion 313.

A loop hole 323 is formed in the neck portion 321 of the whistle cap 310 so that a portable strap or a loop may be fitted into the loop hole 323, thereby improving convenience when the user carries the whistle separately from the buckle.

Meanwhile, covers 110 extend forward at both outer sides of the coupling groove 120 from the base 101 of the plug member 100, and the covers 110 are configured to surround the whistle 300 and the whistle cap 310 coupled to the plug member 100, thereby preventing the whistle from being withdrawn, deformed, and damaged due to external contact. Therefore, the covers 110 are in close contact with lateral portions of the whistle 300 in the state in which the whistle is coupled.

Unlike the first exemplary embodiment, the socket member 200 has a space portion 220 for accommodating the covers 110, and the space portion 220 is formed to occupy the chamber 205 and the guide groove 210 so that the space portion 220 is in close contact with an external shape of the covers 110 when the plug member 100 is coupled.

When the plug member 100 and the socket member 200 are coupled to each other, the locking arms 104 of the plug member 100 are resiliently coupled to the holes 206 through the chamber 205 of the socket member 200, the whistle 300 enters and is seated in the guide groove 210 of the socket member 200 while serving as the guide rod, and the covers 110 of the plug member 100 are tightly coupled to the space portion 220 of the socket member 200.

As described above, when the plug member 100 and the socket member 200 are coupled, the guide groove 210 is completely covered by the whistle 300, and the upper surface of the whistle 300 is flush with the upper surface of the socket member 200, thereby entirely forming integrity.

When using the whistle in the buckle according to the present disclosure, the user uses the whistle after separating the plug member 100 and the socket member 200 and then separating the coupling portion 320 of the whistle cap 310 from the coupling groove 120 of the plug member 100. Because of the engagement between the fixing groove 122 and the fixing protrusion 322, the user separates the whistle cap 310 by pushing the whistle cap 310 toward the interior of the plug member 100 by applying slight pressure to the whistle cap 310.

In addition, when the interior of the whistle 300 is contaminated by foreign substances or the like while in use, the user may separate the whistle 300 and the whistle cap 310 and then clean the interior of the whistle 300.

The present disclosure described and illustrated above is not intended as being limited to the exemplary embodiments and the present disclosure may be modified in various forms without departing from the subject matter of the present disclosure. For example, according to the present disclosure, the whistle is integrally coupled to the plug member and used, such that integrity is formed without impairing a shape of a general buckle or adding other shapes, and this feature may be applied to various buckles used in the related art.

In addition, the whistle serves to produce sound and may be configured in various forms to achieve the purpose of producing sound unless the whistle hinders the engagement between the plug member and the socket member.

Further, the loop hole, which is formed in the whistle cap to connect a portable strap or a loop, may be formed in the whistle.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A buckle assembled with a whistle, the buckle comprising:

a plug member having locking arms formed at both ends at a front side of a base and a guide rod protruding from the base at an intermediate side between the locking arms; and a socket member having a guide groove formed at a center of the socket member so as to be opened at an upper side thereof to accommodate the guide rod at the center and chambers formed at both sides of the guide groove so that the locking arms at the both ends are inserted into the chambers, wherein the guide rod is configured as the whistle with a hollow, extended and longitudinal body having a substantially rectangular cross-section detachably attached to a whistle cap formed on the base, and the whistle cap, extending from a center of the base in parallel with the locking arms, having a substantially rectangular cross-section with narrowing widths such that the whistle cap horizontally slides within the whistle and is fully inserted into the whistle.

2. The buckle according to claim 1, wherein the whistle cap comprises a catching protrusion extending vertically from a proximal end surface of the whistle cap and having a substantially rectangular cross-section formed along a leading edge of the whistle cap.

3. The buckle according to claim 2, wherein the whistle includes a catching groove to which the catching protrusion of the whistle cap is coupled, the catching groove formed in an inner surface at a rear end portion of the whistle.

4. The buckle according to claim 1, wherein an inner surface at a rear end portion of the whistle has a shape corresponding to an outer surface of the whistle cap, such that the inner surface of the whistle and the outer surface of the whistle cap are tightly coupled to each other.

* * * * *